United States Patent [19]

Pflaum et al.

[11] Patent Number: 4,509,733

[45] Date of Patent: Apr. 9, 1985

[54] MULTIPLE PAPER WEB GUIDING AND COMBINING APPARATUS FOR COMBINATION WITH ROTARY PRINTING MACHINE AND FOLDING DEVICE

[75] Inventors: August Pflaum; Albert Mayer, both of Augsburg, Fed. Rep. of Germany

[73] Assignee: M.A.N.-Roland Druckmaschinen Aktiengesellschaft, Offenbach am Main, Fed. Rep. of Germany

[21] Appl. No.: 586,690

[22] Filed: Mar. 6, 1984

[30] Foreign Application Priority Data

Mar. 8, 1983 [DE] Fed. Rep. of Germany ..... 3308069

[51] Int. Cl.[3] ..... B41L 43/04

[52] U.S. Cl. ..... 270/41; 226/176; 226/189

[58] Field of Search ..... 101/224, 219, 225; 270/4-6, 20.1, 41; 226/4, 168, 176, 179, 181, 189-191

[56] References Cited

U.S. PATENT DOCUMENTS

| | | | |
|---|---|---|---|
| 2,358,928 | 9/1944 | Huck | 270/4 |
| 2,631,845 | 3/1953 | Zuckerman | 270/5 |
| 2,746,748 | 5/1956 | Harless | 270/41 |
| 2,813,713 | 11/1957 | Dresser et al. | 270/5 |
| 3,948,504 | 4/1976 | Woessner et al. | 270/41 |
| 4,293,100 | 10/1981 | Sharlow | 226/189 |

FOREIGN PATENT DOCUMENTS 509606 10/1970 Fed. Rep. of Germany ..... 270/41

*Primary Examiner*—E. H. Eickholt

*Attorney, Agent, or Firm*—Frishauf, Holtz, Goodman & Woodward

[57] ABSTRACT

To provide for threading of paper webs to a folding apparatus (140), a plurality of paper webs (1-8; 77-84) are fed from respectively opposite sides to a plurality of deflection rollers directing the paper webs in a vertical combining plane (9). The deflection rollers are positioned in vertically staggered arrangement. The paper webs are positively fed by transport rollers (26-29; 53-56) or transport belts (110-113; 128-130), located on respective carrier plates (18, 19; 93, 94) which are movable towards or away from the combining plane and on which the transport rollers or belts are located, staggered, between the deflection rollers on the same side and so as to engage the deflection rollers on the other side of the combining plane, to provide for positive drive of paper webs and feeding to the folding apparatus (140) during threading, or upon tearing of a web, but permitting withdrawal laterally upon full-speed operation of the paper handling apparatus, for example the folder. Additional transport belts (69, 70; 138, 139), also movable on carriers towards and away from the combining plane, can be provided to transport the combined superposed webs, likewise movable out of engagement with respect to each other, that is, away from the combining plane, after threading has been completed.

13 Claims, 4 Drawing Figures

77
93
95
98
85
110
9
89
81
78
106
128'
119
94
96
99
86
128
82
97
100
111
90
120
118
79
129'
121
107
129
133
101
87
83
134
102
112
91
122
80
130'
123
103
108
130
84
88
104
124
92
105
131
109
132
114
113
115
125
126
127
135
136
116
117
138
139
140

MULTIPLE PAPER WEB GUIDING AND COMBINING APPARATUS FOR COMBINATION WITH ROTARY PRINTING MACHINE AND FOLDING DEVICE

The present invention relates to combining multiple paper webs fed from rotary printing machines systems to a folding apparatus which is arranged for easy servicing and clearing of paper tears or paper jams.

BACKGROUND

Rotary printing machines, for example offset printing machines, frequently supply paper webs to a folding apparatus. The respective multiple paper webs are supplied to the folder by a structure including a plurality of turning bars or the like, and run-in or supply rollers which then feed the paper webs to a combining region, usually a combining plane, for subsequent handling in the folding apparatus (see, for example, German Patent Disclosure Document DE-OS NO. 24 35 583). It is possible that the web may tear as it is being fed to the folding device within the apparatus. It is then necessary to manually thread the respectively torn web through the entire structure. Known web threading devices are only suitable for threading torn paper webs through the printing stations and the dryer, but not through the folding structure itself—see, for example, German Patent DE-PS No. 22 41 127. Manual threading through such a folding apparatus is difficult.

THE INVENTION

It is an object to so construct a multi-web combining apparatus that torn webs can be easily threaded, and which lends itself to combination with an automatic threader so that torn paper webs can be easily re-threaded, manually or automatically.

Briefly, two sets of vertically positioned spaced deflection rollers are located to receive the respective webs, one each from an opposite side of a central combining plane, in which, later, the superposed webs are fed to the folder. Transport means are provided located at the respective sides of the combining plane, outside of the webs, when deflected, for example formed as rollers, belts or the like, and located on support elements so as to be movable towards and away from the combining plane, and thus permit free access for threading of the respective plurality of webs about the deflection rollers, and subsequent transport, while the transport means are away from the combining plane. Upon movement of the transport means towards each other, the webs are positively fed by the transport rollers or belts to the folder.

The system has the advantage that, upon spreading apart of the transport means, away from the combining plane, easy access to the webs is provided, so that any torn web can be readily re-threaded, and space is provided for automatic threading apparatus to engage the webs. Once the webs are threaded, of course, the space is no longer required since the threading apparatus, or the operator's hand will be removed.

DETAILED DESCRIPTION

Figure 1:
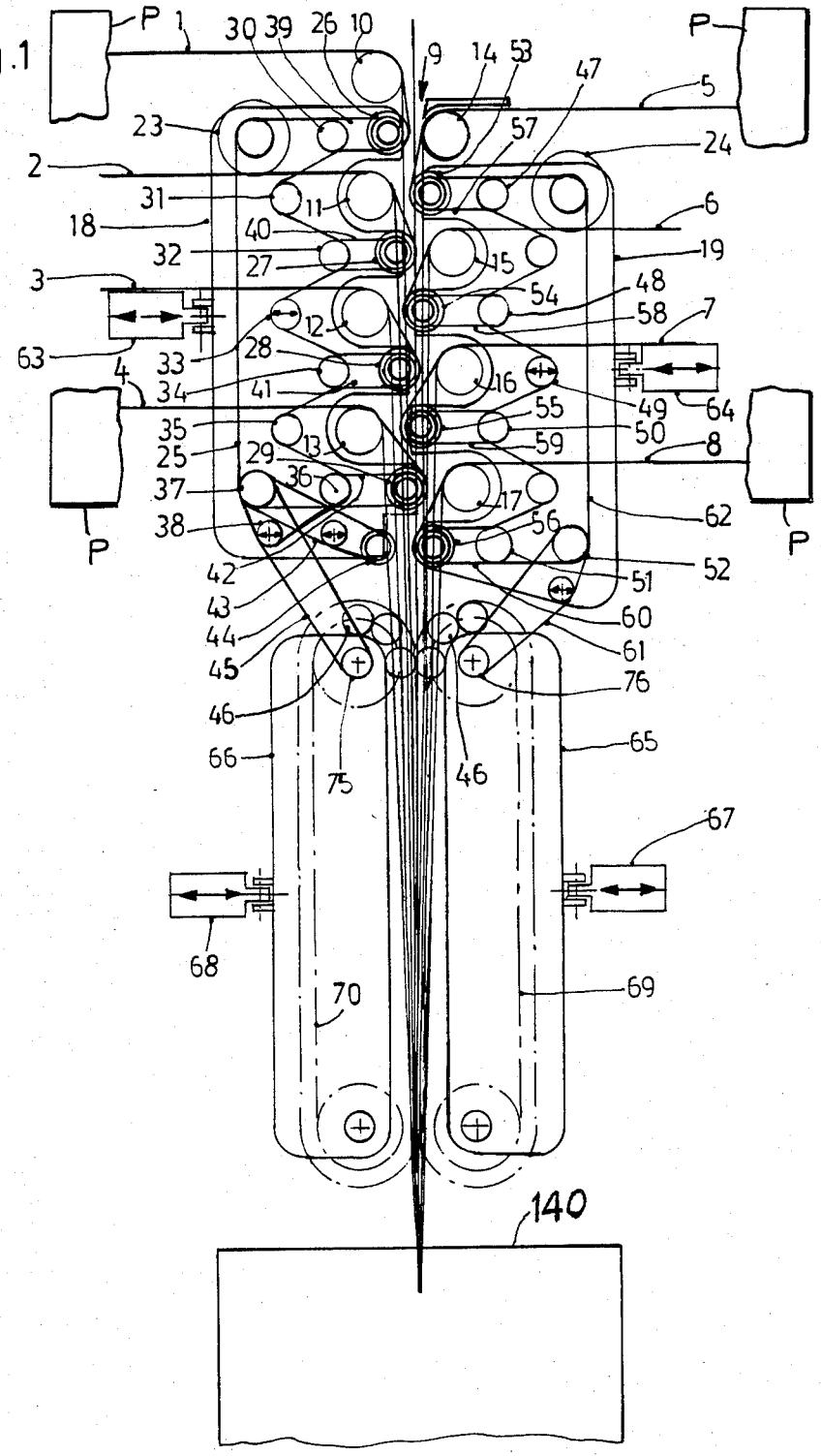
FIG. 1 illustrates a threading apparatus for a plurality of webs, in side view, to feed webs in a combining plane to a folding apparatus.

A plurality of paper webs 1–4, derived from printing machine sections of a printing machine, shown only schematically at P, is fed from the left side—with respect to FIG. 1—of a combining plane 9. Similarly, a plurality of webs 5–8 are fed from printing machine sections of the printing machine P at the right side, with respect to FIG. 1. The respective webs 1–8 are guided to operate horizontally and are then deflected towards a vertically extending combining plane, in which they are superimposed and guided, while laid above each other, to a folding apparatus shown only schematically at 140. The folding apparatus may be of any suitable and well-known construction, and does not form part of the present invention.

Each one of the webs 1–8 is guided about a deflection roller 10–17. The deflection rollers are journalled only at one end, that is, they are supported in cantilever manner, and may be referred to as supply or feed rollers. They may be idling or, if desired, can be driven. As seen in FIG. 1, four such deflection rollers 10–13 are located on the left side of the plane 9, and four rollers 14–17 on the right side. The rollers are vertically stacked and, in accordance with a feature of the invention, are vertically staggered.

Figure 2:
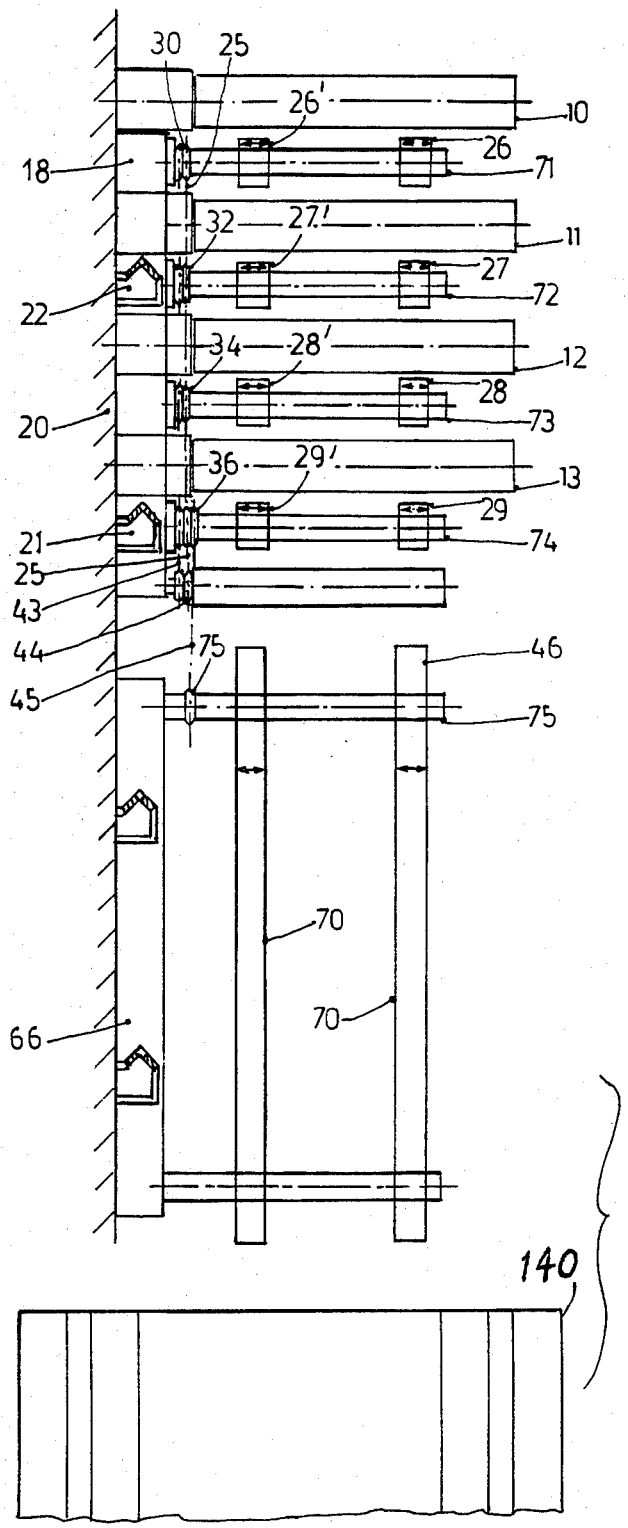
FIG. 2 is a front view of the apparatus of FIG. 1.

A plate-like carrier 18, 19—see FIG. 1—is located at either side of the combining plane 9. Only carrier 18 is seen in FIG. 2; carrier 19 is the mirror image thereof, and otherwise identical. The carriers 18, 19—as best seen in FIG. 2—are slidably positioned in the side wall or side wall frame 20 of the apparatus. Guide elements 21, 22 are located on the side wall frame 20 and engage in suitable guide tracks in the carrier elements 18, 19, not further shown, and of any desired construction. In accordance with a feature of the invention, the carriers 18, 19 are movable in a plane which extends at an approximately right angle with respect to the combining plane 9.

Each one of the carriers 18 supports a drive motor; motor 23 is secured to carrier 18, motor 24 to carrier 19. The drive motor 23 is coupled to a drive belt 25 which, in turn, drives pulleys or drive elements 26–29, likewise located on the slidable carrier 18. The carrier 18, preferably, is in plate form. The drive elements 26–29 are shown in FIG. 1 as drive rollers. The belt 25, coupled to motor 23, is then looped in S form over belt pulleys 30–37; if a chain is used, the pulleys 30–37 would be replaced by sprockets. As best seen in FIG. 2, pulleys 30, 32, 34, 36 are formed as double-disk or triple-disk pulleys. The belt running downwardly from the pulley 36 is stretched by a tension roller 38. The remaining double pulleys or double disks 30–36 are coupled to belts 39 to 42, or suitable chains in lieu of belts, which drive rollers 25–29 at the left side of the combining plane 9, and which are located on the same level as the deflection rollers 14–17 on the right side of the plane 9. A further roller 44 is located beneath the roller 29, driven by a belt or chain 43, and forming a counter roller since such a roller is desirable and, in many constructions, indeed required below the deflection roller 13.

A belt 45, exrtending downwardly, with an inclination, and driven likewise by the belt 25, is coupled to a further pulley 46, as will be described in more detail below.

The plate-like carrier 19, at the right side of the plane 9—with respect to FIG. 1—is constructed essentially in mirror-image form, and carries the belt disks 47–52. Rollers 53–56 form the transport means on the plate-like carrier 19, located above each other, and approximately on the same level as the deflection rollers 11–13, and on the additional roller 44, respectively. A drive belt 61, corresponding to belt 45, is looped over the belt disks or pulley 52.

The belt 62, directly driven by motor 44, is looped in approximately S shape about the respective pulleys or disks on the carrier 19. Only the left rollers have been given reference numerals 47–51. Belts 57 to 60 additionally drive rollers 53–56.

In accordance with a feature of the invention, the entire transport mechanism formed by the respective rollers can be moved towards and away from the combining plane 9. As shown, horizontally movable shifting mechanisms 63, 64, coupled to the carrier plates 18, 19, move the carrier plates and with it the respective rollers away from and towards the combining plane 9. The moving elements may be magnetic shift solenoids, hydraulic or pneumatic cylinder-piston arrangements or the like, i.e. any suitable apparatus to horizontally move the carrier plates.

When the carrier plates are shifted towards each other, rollers 26–29 are in approximately horizontal alignment, for circumferential tangential engagement—with the webs interposed—with the deflection rollers 14–17; rollers 53–56 are in approximately horizontal alignment, and in tangential engagement, with the webs interposed, with the deflection rollers 11–13 and the counter roller 44, respectively. The carriers 18, 19 are formed with suitable recesses or cut-outs which are positioned to surround the stationary deflection rollers 11–17. The recesses are shown in FIG. 1, but not further identified by reference numerals to prevent cluttering of the drawing.

Threading, and operation: To thread the webs 1–8 into the apparatus, they are guided as closely as possible towards the combining plane 9. Carriers 18, 19, by suitable operation of the shifting apparatus 63, 64, are pulled back away from the combined plane. This permits placing of the respective ends of the webs 1–8 about the associated deflection rollers 10–17 to the combining plane 9. After the paper webs have been placed over the respective rollers, they are drawn slightly downwardly. Thereafter, the moving mechanism 63, 64 is energized to push the carrier plates 18, 19 towards each other, so that the respective paper webs 1–8 are gripped between the deflection roller and the oppositely positioned counter roller against which the respective webs will then be placed. Upon starting of the motors 23, 24, the respective individual webs 1–8 will be drawn between the roller 26 and the oppositely located deflection roller 14; between the deflection roller 11 and the oppositely positioned transport roller 53; between the transport roller 27 and the oppositely positioned deflection roller 15—and so on. Upon drive of the respective rollers, the individual webs are drawn downwardly until the leave the region of the carrier plates 18, 19 and reach the zone of a pair of drive belts 69, 70, located on respective carriers 65, 66 which are likewise shiftable to-and-fro with respect to the combining plane, under operation of shifting apparatus 67, 68, for example electrically, mechanically, hydraulically, or pneumatically operated.

The rollers 26–29, see FIG. 2, are axially shiftable on cross rods 71–74. Preferably, additional rollers 26'–29', identical to rollers 26, 29 are also used. Upon shifting of the respective rollers 26–29 and/or 26'–29' respectively on the cross rods 71–74, the feeding apparatus can be matched to desired widths of paper webs.

When the respective, then superposed webs 1–8 are passing between the belts 69, 70 located on the carriers 65, 66, the shift mechanism, for example cylinder-piston arrangements 67, 68, are energized to move the carriers 65, 66 towards the combining plane, so that the respective webs are gripped by the belts 69, 70, and drawn downwardly. Belts 69, 70 are driven by the drive belts 45, 61, indirectly, via pulleys or belt disks 75, 76, located on the carriers 65, 66. The belt disks 75, 76 may carry peripherally located brushes 46, or further sub-rollers, in order to facilitate introduction of the respective webs 1–8 between the belts 69, 70.

As soon as the webs 1–8 are gripped by the belts 69, 70, the carriers 18, 19 may be drawn outwardly again so that the rollers 26–29 and 53–56 cause only slight transport effect, but contribute to smoothing any possible wrinkles or folds of the webs 1–8 passing thereover.

The webs 1–8, after leaving the belt transport 69, 70 are then guided to the folding apparatus 140 for subsequent folding and handling, as only schematically shown in FIGS. 1 and 2, since the folding operation and structure, as such, does not form part of the present invention.

Figure 3:
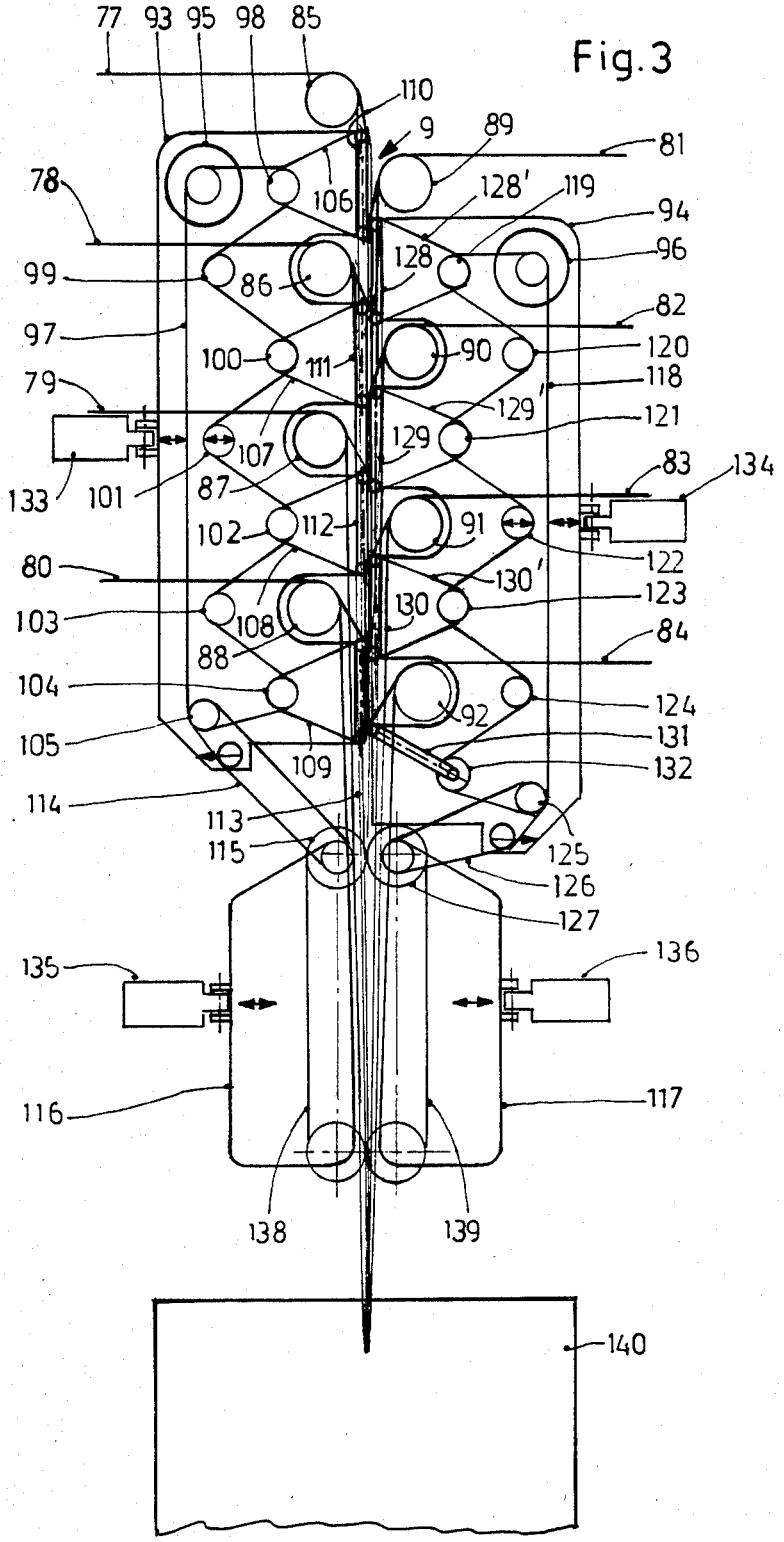
FIG. 3 is a side view similar to FIG. 1, and illustrating another embodiment.
Figure 4:
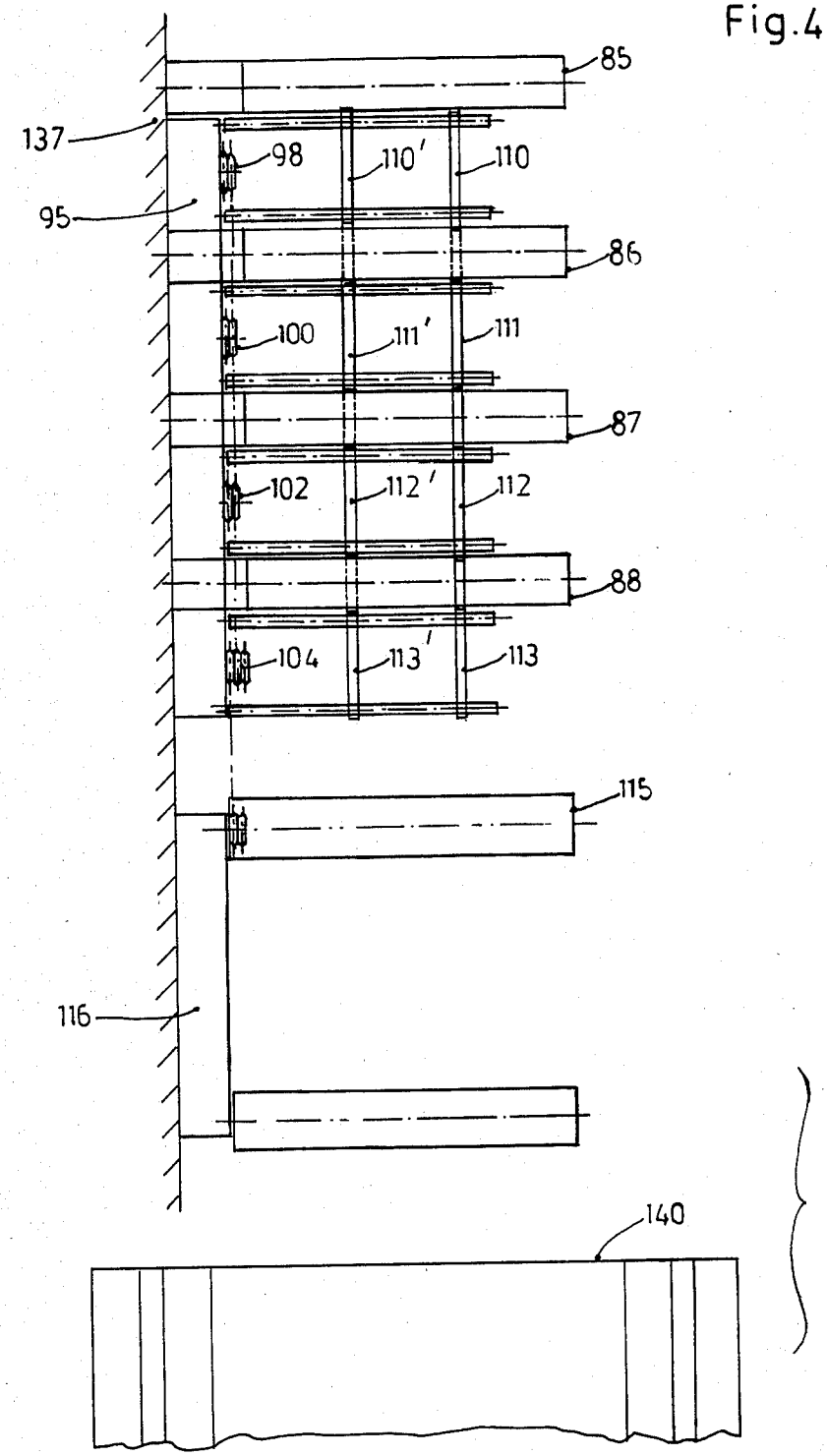
FIG. 4 is a front view of the embodiment of FIG. 3.

Embodiment of FIGS. 3 and 4: A particularly preferred embodiment of the invention utilizes vertically shifted or offset or staggered belts rather than rollers 26–29 and 53–56 positioned on both sides of the combining plane 9. The general construction of the apparatus in accordance with FIGS. 3 and 4 is similar to that shown in FIGS. 1 and 2, and, indeed, may be identical thereto.

Referring to FIG. 3, from which all elements not necessary for an understanding of the modifications have been omitted: Individual webs 77–84, fed, as before, from a printing machine (not shown in FIGS. 3, 4), are guided to deflection rollers 85–88 at the left side, and 89–92 at the right side of the combining plane 9. Carrier plates 93, 94, slidable in the frame of the machine, are located thereon, the carrier plates being formed with cut-outs or notches to surround the respective deflection rollers 86–92, as shown. Drive motors 95, 96 are located on the carriers 93, 94. Motor 95 drives a belt 97 which is guided in an S-path about belt disks 98–104, and the disks 98, 100, 102, 104. Belt 97 is returned over a further return disk or pulley 105 to the motor 95. The pulleys 98, 100, 102, 104 drive belts 106–109. The respective belts 106, 107, 108, 109 are associated with transport belts 110, 111, 112, 113, belts 110–113 forming transport belts which are located laterally of the combining plane 9. A drive pulley 115 is located beneath the belts 110–113, driven by a belt 114. The pulley 115 is located on a slidable carrier 116, positioned beneath the plates 93, 94. At the right side, the plate 94 carries motor 96 which drives a belt 118 which is looped in an S-path about the belt disks 119 to 124, and a belt disk 125 which drives the belt 126. The belt 126 drives a pulley 127. Suitable stretching rollers may be used, as well known, and are not further identified for clarity of the drawing.

The pulleys, formed as double belt disks 119, 121, 123, drive the belts 128', 129', 130', located at the right side of the combining plane 9, and staggered vertically with respect to the feed belts 110–113 at the left side, and associated with the belts 128, 129, 130, 131.

Operation, and threading: Before feeding paper webs to the apparatus, the respective carriers 93, 94 are drawn outwardly by operation of the shifting apparatus 133, 134, for example hydraulic piston-cylinder operators. After placement of the webs over the respective feed rollers 85–88 and 89–92, the shifting apparatus 133, 134 is again operated to move the respective carriers 93, 94 towards the combining plane. As soon as the individual webs 77–84 are contacted and transported by the belts, the carriers 93, 94 by operation of the apparatus 133, 134 are further pushed towards the combining plane 9, so that the belts 110–113 and 128–131, respectively, will grip the webs 77–84. For example, the web 77, being fed over the upper roller 85 from the left side, will be gripped by one end portion of the belt 110 and one end portion of the belt 128. The web 81, coming from the right side, is likewise gripped between the transport belt 110 and the transport belt 128. The web 78, coming from the left side, is first gripped by the upper end portion of the guide belt 111, and then by the lower portion of the belt 128; the web 82, coming from the right side, is gripped by the lower end of the belt 111 and the upper end of the belt 129. The remaining webs are guided and transported in similar manner.

When the respective webs 77–84, combined as above explained, leave the lower region of the apparatus, that is, below the carriers 93, 94, they will the zone of transport belts 138, 139 located on carriers 116, 117. Carriers 116, 117 are likewise shiftable towards and away from the combining plane 9 by shift apparatus 135, 136, for example hydraulic cylinder—piston arrangements. During threading, the carriers 116, 117 are shifted apart. When the webs 77–84 reach the zone of the belts 138, 139, shifting apparatus 135, 136 shifts carriers 116, 117 such that the belts 138, 139 thereof will grip the webs 77–84 and draw them, together, downwardly to the folding apparatus 140, for subsequent handling in accordance with well-known procedures. After the webs 77–84 have been gripped by the belts 138, 139, the carriers 93, 94 with the belts and motors thereon can be separated again.

Carriers 18, 19, 65, 66 (FIGS. 1, 2) and 93, 94, 116, 117 (FIGS. 3, 4) can be moved outwardly after the respective webs 1–8 or 77–84 have been positively introduced and are being transported by the subsequent apparatus, as shown the folder 140, for subsequent handling of superposed webs and transport from the folder.

Various changes and modifications may be made, and any features described herein may be used with any of the others, within the scope of the inventive concept.

We claim:

1. For combination with a rotary printing machine (P) and paper handling apparatus (140), a paper web guiding, transporting and combining apparatus having a frame (20, 21, 22, 18, 19);

and comprising, in accordance with the invention, a first set of vertically positioned, spaced deflection rollers (10–13; 85–88) positioned to receive a first plurality of paper webs (1–4; 77–80), and deflecting the webs for travel in a vertical direction, and for guiding the webs into a vertically positioned combining plane extending at least approximately tangentially to said rollers, and towards said paper handling apparatus (140);

a second set of vertically positioned spaced deflection rollers (14–17; 89–92) positioned to receive a second plurality of paper webs (5–8, 81–84) from a direction opposite the first direction, and deflecting said paper webs for travel in a vertical direction and into said combining plane, parallel to and adjacent said first plurality of webs and towards said paper-handling apparatus, the rollers of the second set of rollers being vertically staggered or offset with respect to the rollers of the first set;

and transport means (26–29, 53–56; 110–113, 128–130) located outside of the combining plane (9) at both sides thereof, movable toward and away from the combining plane to permit threading of the respective plurality of webs about the respective deflection rollers while the transport means are located away from the combining plane, and subsequent movement of the transport means to the combining plane and engagement of the transport means with the respective webs of said first and second plurality of webs.

2. Apparatus according to claim 1, further comprising two carrier structures (18, 19; 93, 94) movably located on said frame for movement towards and away from said plane (9);

and wherein said first and second sets of the deflection rollers are located on respective ones of the carrier structures;

and wherein the transport means comprises first and second transport sets, one each being located on one of the carrier structures.

3. Apparatus according to claim 2, wherein (FIGS. 1, 2) the transport means of the respective transport sets comprises driven rollers or rotary brushes (26, 29; 53–56), located in respective horizontal alignment with associated deflection rollers of the set of deflection rollers at the opposite side of the combining plane.

4. Apparatus according to claim 2, wherein (FIGS. 3, 4) the transport means comprises a drive belt (111) located on one (93) of said carrier structures and positioned between two vertically located deflection rollers (86, 87) supported on said carrier structure;

and wherein the belt (111) is guided to have an upper and a lower portion in the region adjacent the combining plane, said upper and lower portions being movable towards the combining plane (9) between two vertically staggered deflection rollers (89–90; 90–91) on the other carrier structure (94).

5. Apparatus according to claim 4, wherein a drive motor (95, 96) is located on each one of the carrier structures (93, 94);

a drive belt (97, 118) is coupled to each one of the drive motors (95, 96);

and drive belt means (106–109; 128–131) are provided, coupled to and driving the respective transport belts (110–113; 128–130).

6. Apparatus according to claim 1, further including additional transport means (69, 70; 138, 139);

horizontally movable carrier elements (65, 66; 116, 117) supporting said additional transport means, said additional transport means being movable towards and away from the combining plane (9) by movement of the respective carrier elements for transporting superposed webs (1–8; 77–84), superposed and combined by the respective sets of deflection rollers and the transport means.

7. Apparatus according to claim 2, further comprising horizontally acting power means (63, 64; 133, 134) acting on the respective carrier structures to move said carrier structures towards and away from said combining plane.

8. Apparatus according to claim 6, further comprising additional horizontally acting power means (67, 68; 135, 136) acting on the horizontally movable carrier elements to move said carrier elements towards and away from said combining plane.

9. Apparatus according to claim 2, wherein the carrier structures (18, 19; 93, 94) are positioned on the frame for lateral sliding movement towards and away from said combining plane.

10. Apparatus according to claim 6, wherein said carrier elements are positioned on the frame for lateral sliding movement towards and away from said combining plane.

11. Apparatus according to claim 9, wherein said deflection rollers (10–13; 14–17; 85–88; 89–92) are journalled on said frame.

12. Apparatus according to claim 1, wherein the deflection rollers of the respective sets of deflection rollers are driven.

13. Apparatus according to claim 1, wherein the plurality of paper webs are guided towards the deflection rollers in an essentially horizontal direction;

and wherein said paper handling apparatus comprises a folding apparatus (140) located vertically beneath the horizontally guided webs, and having a superposed web-receiving portion located in said combining plane.

* * * * *